United States Patent [19]

Mittelmann

[11] 4,212,406

[45] Jul. 15, 1980

[54] CONTAINER, IN PARTICULAR FOR TRANSPORTING FREIGHT BY AIR

[75] Inventor: Gerhard Mittelmann, Oehningen, Fed. Rep. of Germany

[73] Assignee: Swiss Aluminium Ltd., Chippis, Switzerland

[21] Appl. No.: 62,163

[22] Filed: Jul. 30, 1979

[30] Foreign Application Priority Data

Aug. 4, 1978 [DE] Fed. Rep. of Germany ..... 2834175

[51] Int. Cl.[3] ..... B65D 88/52

[52] U.S. Cl. ..... 220/1.5; 150/0.5; 220/4 F; 220/84; 29/448; 29/462

[58] Field of Search ..... 150/0.5; 220/1.5, 4 F, 220/84; 29/448, 462

[56] References Cited

U.S. PATENT DOCUMENTS

| | | | |
|---|---|---|---|
| 3,044,656 | 7/1962 | Combs | 220/1.5 X |
| 3,784,043 | 1/1974 | Presnick | 220/84 X |
| 3,853,239 | 12/1974 | Meller | 220/1.5 |
| 3,907,148 | 9/1975 | Meller | 220/1.5 |

*Primary Examiner*—Donald F. Norton

*Attorney, Agent, or Firm*—Bachman and LaPointe

[57] ABSTRACT

A container, in particular a container for transporting freight by air, is made of profiled rods or spars which form a structural frame which is covered at least in part by sheeting, fabric or the like so that the covering acts in tension on the structural frame and is counteracted by compressive elements in the frame of the container.

12 Claims, 10 Drawing Figures

CONTAINER, IN PARTICULAR FOR TRANSPORTING FREIGHT BY AIR

BACKGROUND OF THE INVENTION

The present invention relates to a container designed for transporting freight by air and comprises profiled rods or the like, struts and spars, which form a supporting frame, which is covered at least in part with sheeting, fabric or like surface elements which provide an outer "skin" for the container.

Known containers available at present suffer from the disadvantage that parts damaged by rough handling can be repaired only at considerable expense due to the fact that the sheeting, planks or panels are rivetted to the supporting frame and therefore can not be easily replaced.

Replacement of individual, damaged container parts by new undamaged parts is possible in so-called panel type constructions where each surface or wall of the container is made up of a special frame with a covering. The advantage of easy exchangeability and the high degree of stability of corners or edges produced by fitting together two struts or sections of a panel or panels is achieved at the expense of an increase in weight which is undesirable when the containers are used for transporting freight by air.

Therefore, it is the principal object of the present invention to develop a container for freight transport which is characterized by low weight and high stability wherein the surfaces or walls of the container are easily exchanged and can be prefabricated in a simple manner.

SUMMARY OF THE INVENTION

The foregoing object is achieved by way of the present invention where the outer covering or skin, or part thereof, is arranged on profiled rods or struts of the structural frame so as to act in tension on the frame. The rods are spaced apart and are joined together by means of compressive or spreading elements, which act with a force counter to the tension action of the covering.

In accordance with another embodiment of the present invention, the covering comprises material which is rigid at least in one direction and is introduced as a compressive element between the profiled rods which are to be joined, and which hold the covering by acting in tension.

In both of the above cases it is advantageous for the component acting in tension to exhibit hook-shaped sections in the direction of tension, which can be joined releasably to members on the profiled rods pointing in the opposite direction.

In a particularly favorably designed container, a plurality of profiled rods are fitted together to provide a sidewall frame for the container. Two such sidewall frames are positioned at a distance facing each other and joined by transverse spars attached at or near the corners of the frame. The covering acting in tension is fitted between the two sidewall frames.

For example, the top sheets for the roof and sides are fitted via their hook-shaped sections to the two above mentioned sidewall frames and the distance between the sidewalls then is increased via the transverse spars until the sidewall frames and covering sheets engage firmly with each other.

The sidewall frames can either be welded at the corners or connected by means of corner pieces which simultaneously provide a means of connecting the transverse spars. In accordance with a further feature of the present the transverse spar has at its end a plug which fits into a box-shaped projection on the profiled rod or corner piece. The plug can be moved by means of an adjusting device such as screws or spindles. It is also conceivable to make the transverse spars so that the length of the spars can be varied.

Two opposite edges of the covering sheets, panels or the like have the above mentioned hook-shaped sections fitted to them. These hooking facilities can be specially made and rivetted or otherwise attached to the covering. Alternatively the hooking facilities can be provided by shaping the covering material itself into the appropriate form. The other two edges are, in accordance with the present invention, provided with holes or the like through which screws or push-fit connecting pieces, are fitted and pass through similar holes in the transverse spars. This construction provides further stability for the structural frame in addition to the bracing effect of the panels and the frame as described above.

The production of the containers is simplified because it is no longer necessary to rivet or weld all edges of the panels to the profiled rods. Instead, production can begin with coiled or stacked sheet. The fitting of the hook-shaped sections is necessary on only two sides, the bending, boring, separation of two cover sheets may even be accomplished in one single step.

A further advantage of the present invention is that containers of different widths can be produced by simply changing the length of the transverse spars and the breadth of the cover sheet without requiring any special alterations to the basic construction itself.

It is also within the scope of the present invention to provide a door which is light and can be quickly mounted to the frame. To this end, a door made of a flexible material is introduced into an opening surrounded by four profiled rods. This door is hinged, preferably on the overhead rod of the doorway, and releasably attached to the sideposts of the doorway by a series of hook-like members. A folded seam of the door material, which can be pushed into an undercut groove in the overhead rod, serves as the hinge. The so-called rolled seams are generally known, for example in the text of the German registered Utility Model No. 1 957 424.

It has been found to be particularly useful for the door of the present invention to make the undercut part of the groove oval in cross section and its main axis to run approximately in or parallel to the plane in which the door hangs. This causes the hinge part of the door to clamp itself in the groove in the overhead rod of the doorway. The undercut part of the groove can also be made to taper towards one end of its long axis so as to increase the clamping action of the door.

In contrast to the normal container doors which have transverse aluminum sections and are closed by locks, the door of the present invention has flexible belts which are provided with hook-shaped members at their ends.

The hook-shaped members are engage in grooves in the profiled rods. The flexible belts are tightened and locked by means of conventional buckles.

BRIEF DESCRIPTION OF THE DRAWINGS

Further objects and advantages, of the present invention will be made apparent from a consideration of the following illustrative drawings wherein.

DETAILED DESCRIPTION

A container B, used for transporting freight by air, has a frame 1 which determines the shape of the container, a square shaped base C, a roof panel D, wall panels E, F and G forming the end walls of the container and a door H at the side.

Figure 1:
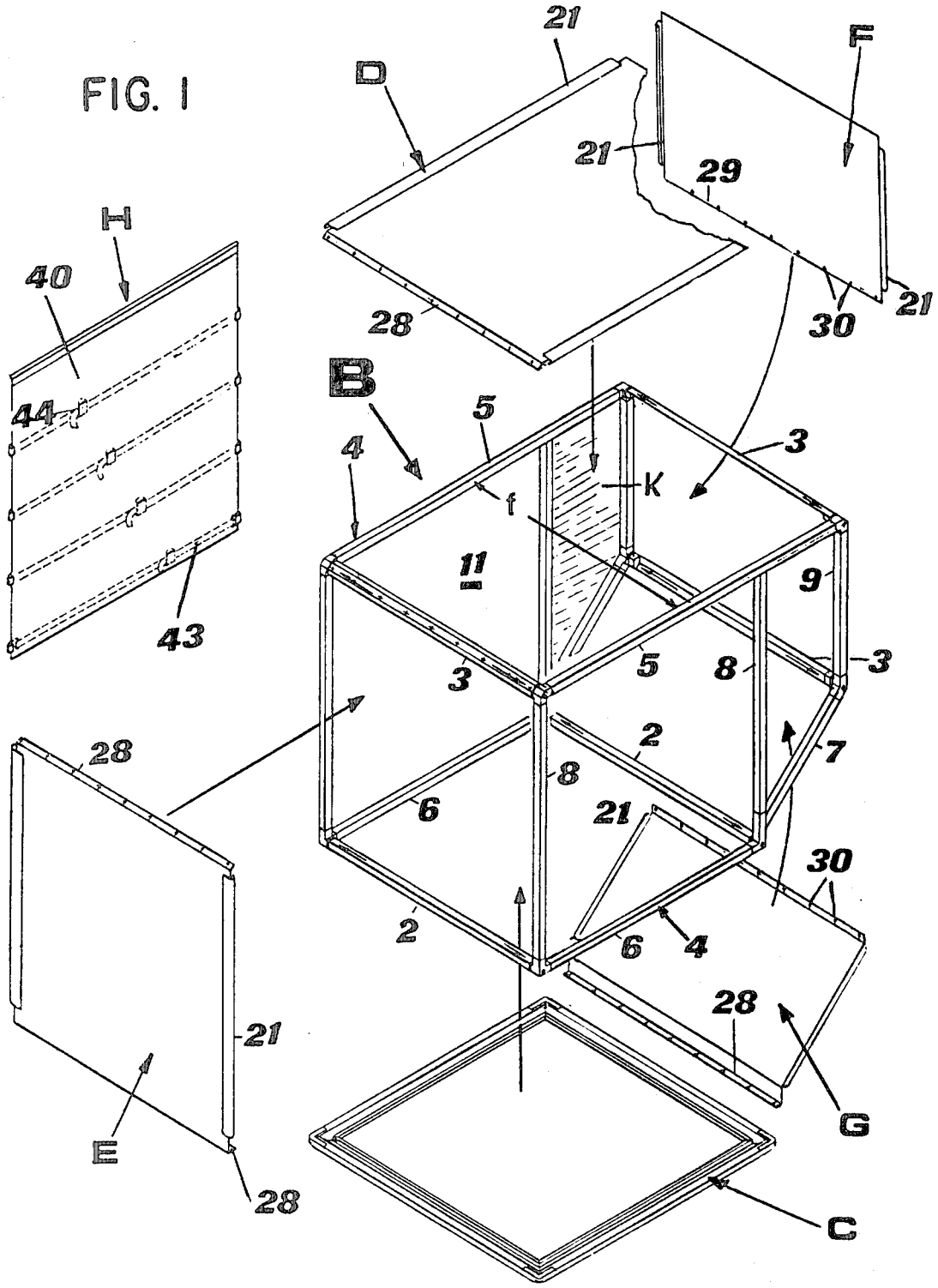
FIG. 1: Is a perspective exploded view of a container of the present invention showing the individual parts which fit on to the container frame.

The individual parts C to H illustrated in FIG. 1 are shown separated from the frame. On the other hand, the sidewall panel K which joins panels F and G at the edge is shown on place in the frame 1. The front side of the container facing the viewer can be closed off by a door H and an additional side panel K or else by another wall panel Q, see FIG. 3.

The frame 1 comprises two sidewall frames 4 joined by transverse spars 2,3 of length q. Each of the frames 4 is made up of a section 5 (length a, for example 200 mm), a shorter section 6 at the bottom of length b (e.g. 150 mm), a section 7 inclined to the base section 6 at an angle w in the plane of the frame, and three vertical supports 8 and 9 with connecting pieces 10 at the corners.

The vertical support rod 9 which is assigned to the rear panel F is shorter than the other two vertical supports by a length c which represents the side facing the angle w in a triangle in which the sloping section 7 forms the hypotenuse e. The long vertical supports 8 of the sidewall frame flank an opening 11 for a door H or a panel Q of the same size as door H. As has already been explained, the panel Q can extend over the whole of the sidewall frame 4.

Figure 3:
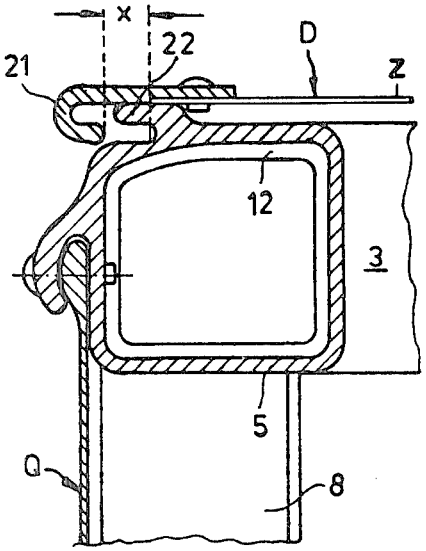
FIG. 3: Is an enlarged cross sectional view through a part in FIG. 2 sectioned along line III—III.
Figure 4:
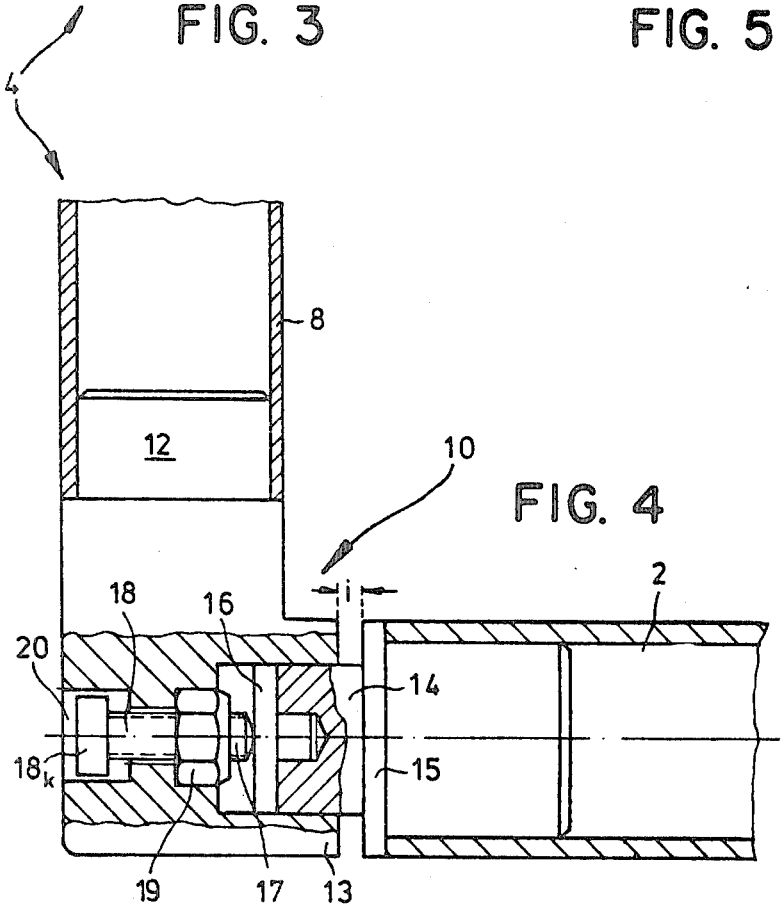
FIG. 4: Is an enlarged detailed view taken from FIG. 2 along line IV—IV.
Figure 7:
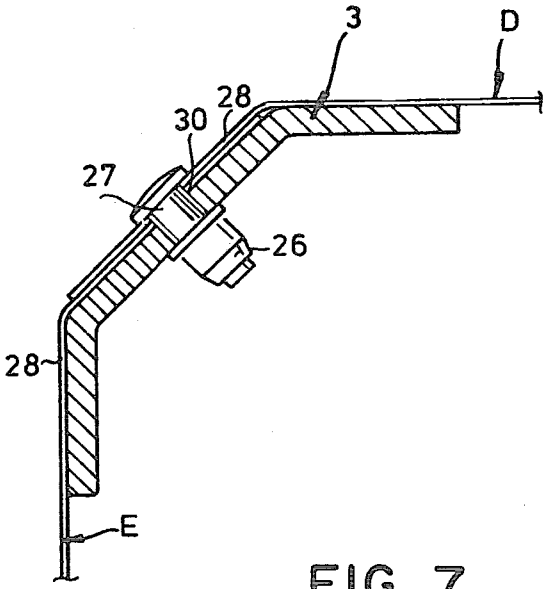
FIG. 7: Is a further detailed sectional view taken from FIG. 2, along line VII—VII.

As is shown in FIGS. 3 and 4 which are aligned with one another, the top section 5 and the vertical supports of both sidewall frames 4 form a box-like section in which the corner pieces 10 are mounted by push-fit parts 12 or similar means. Plugs 14 on the end fittings 15 on the transverse spars 2 (3) fit into box-shaped sockets 13 which point towards the spars 2 and 3. Pressure plate 16 on the plug 14 rests in contact with the free end 17 of an adjustable screw 18 which can be turned from the outside of the frame. The adjusting screw 18 runs in a nut 19 held by the corner piece 10. The head $18_k$ of the screw 18 is contained and moves in a recess 20 in the corner piece 10.

Figure 2:
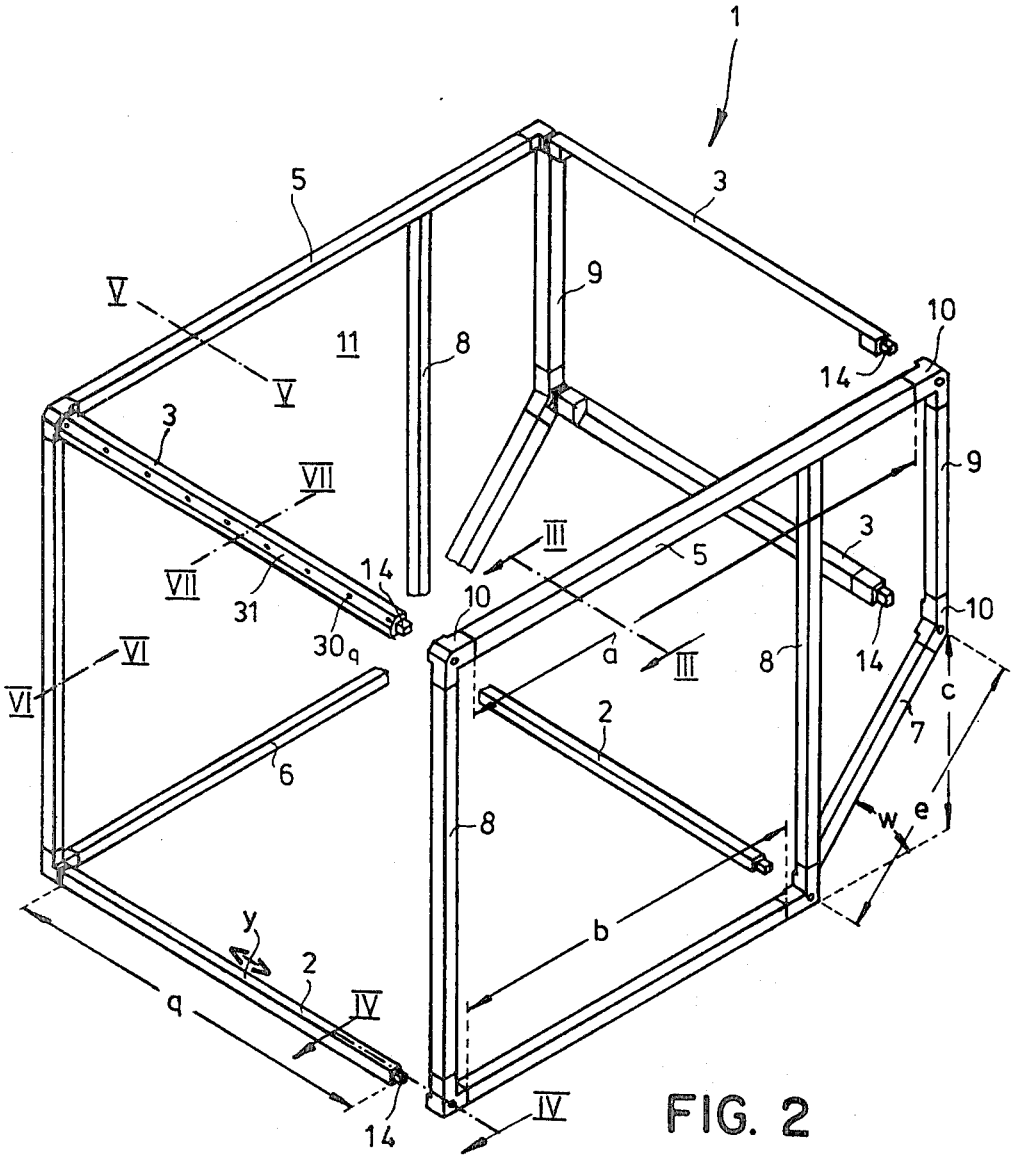
FIG. 2: Is an enlarged view of the frame shown in FIG. 1.

If, for example, the roof panel D is laid on the top sections 5, of both long sides of the container B, such that, (as in FIG. 3) the hook-shaped sections 21 rivetted to the edges of sheet Z of the roof panel D do not engage with the counterlying recesses formed by the projections 22, the hook-shaped sections 21 and the neighbouring recesses 22 can be engaged with one another by pushing the sideframes outwards in direction y (FIG. 2). To this end, the distance i between the fittings 15 at the ends of the transverse spars 2 and 3 and the end face of the box-shaped sockets 13 of the corner pieces 10 is increased by adjusting screw 18. The distance which the sidewwall frame 4 is displaced is indicated by x in FIG. 3. The distance between the top sections 5 settled by the roof pane D and the transverse spar 3 is denoted by f.

Figure 5:
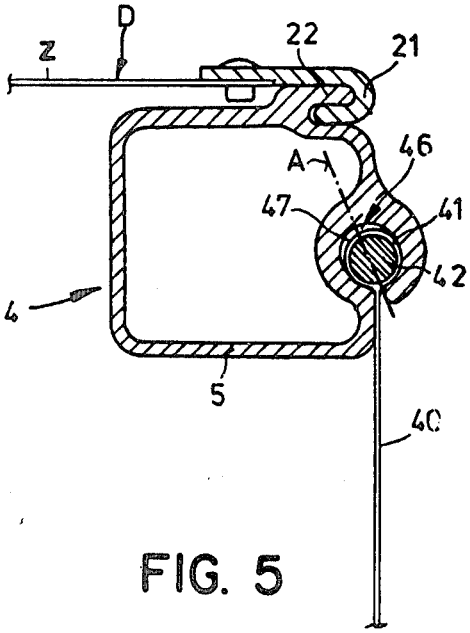
FIG. 5: Is another enlarged detailed view taken from FIG. 2 at approximately line V—V, showing another cross-sectional shape of the part illustrated in FIG. 3.
Figure 6:
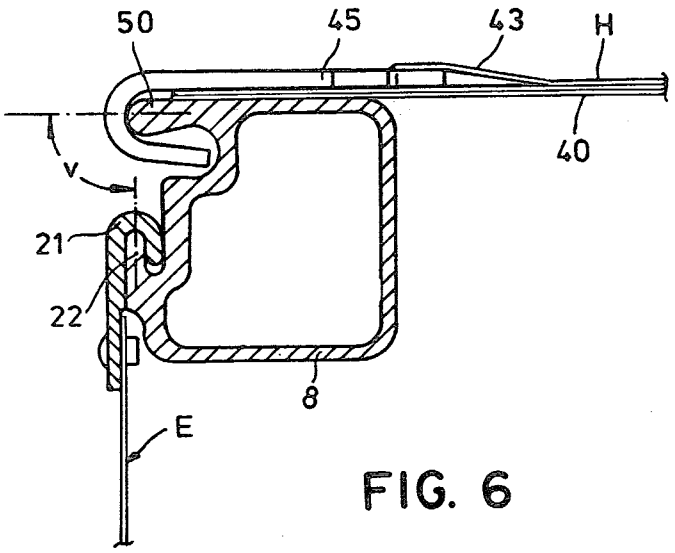
FIG. 6: Is a partial sectional view of the part corresponding to that shown in FIGS. 3 and 5 taken along the line VI—VI of FIG. 2.
Figures 8, 9:
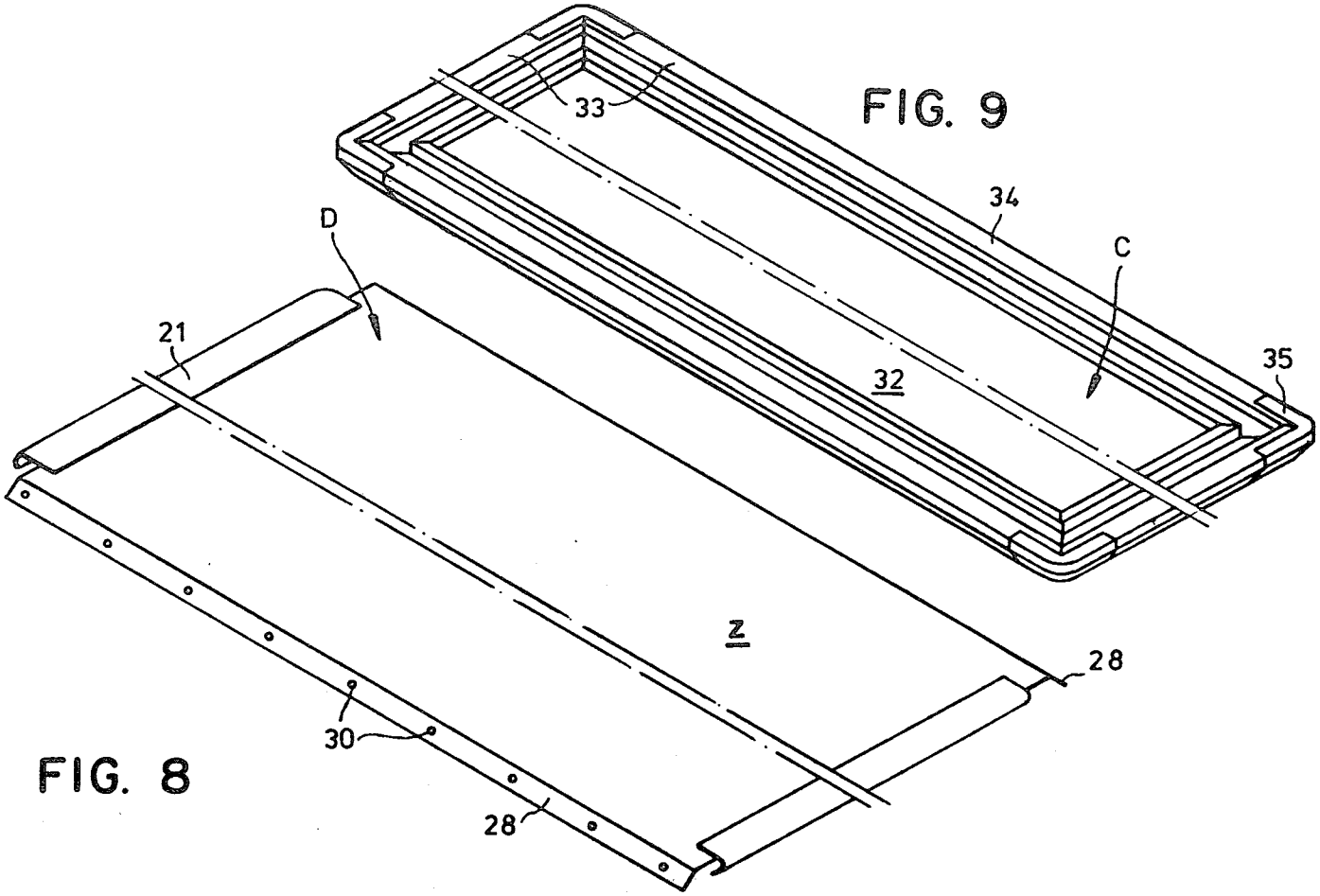
FIGS. 8–10 Illustrate various component parts shown in FIG. 1.
Figure 10:
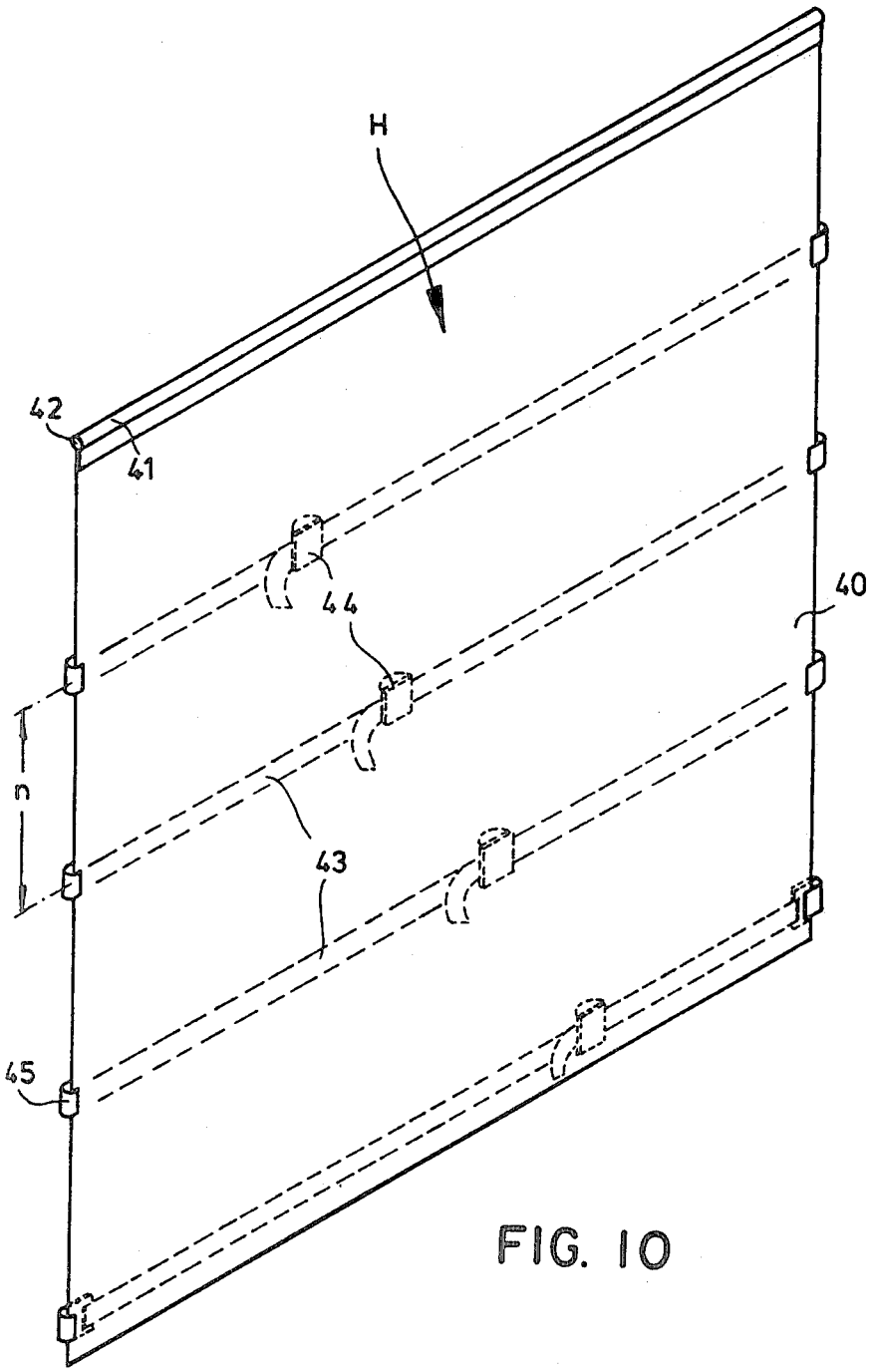

FIGS. 5 and 6 illustrate the proper resting position for the hook-shaped section 21 of the roof panel D in the channel formed by projection 22 in the top section 5. In the assembled position the sidewall frames 4 are stable, being braced between the roof panel D which applies tension and the wall panels E, F, G and the transverse spars 2,3 which apply compression.

When the container B has been put together in this manner, the roof panel D is screwed onto the spars 2,3—in the same way as the wall panels—by means of nuts 26 on screw bolts 27 or so-called Huck bolts. To this end, the roof panels D and the wall panels E, F, G are provided at the edges 28, 39 with a series of holes 30 which can be aligned with corresponding holes $30_q$ in the spars 2,3. The edges 28 in the roof section, the large end panel E and the inclined wall panel G are bent approximately 45° out of the plane of the panels. The lower edge of panel 6, as viewed in the assembled position, is in fact bent twice. Bending the edge regions 28 makes them, and the corresponding surfaces 31 on the transverse spars 2 and 3, readily assessible for the bolting operation.

After the initial assembly and bracing of the parts together under tension and compression, the base C which is made up from a panel 32 and a frame 33 of sections 34 and corner pieces 35 is put into position under the container B and secured there, by means of bolts.

The door H comprises a covering 40 with a round rod 42 held in a pocket 41 at the top. There are also horizontal belts 43 at a vertical spacing n apart, and having tightening buckles 44 and hooks 45 at the ends.

As shown in FIG. 5, to secure the door H in place, its pocket 41 at the end, reinforced by a round rod 42 to form a rolled seam, is pushed into the undercut groove 47 formed by the channel-shaped profile 46 on one side of the top section 5. Because of the oval shape of the interior of groove 47, which is shown clearly in FIG. 5, the rolled seam 41–42 is held securely in place by its own weight. The main axis A of the inner part of the groove 47 runs approximately in line with the door H.

A projection 50 pointing away from the opening 11 for the door is provided for the belt hooks 45 on each of the long, vertical supports 8. Viewed in cross section the projection 50 forms a right angle v with projection 22 for the hook-shaped section 21 on the end wall E.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container for use in transporting freight comprising a first and second plurality of profiled rods;

a first and second plurality of tripodal corner members each having first, second and third legs;

securing means associated with said first and second profiled rods and said first and second legs of said first and second corner members for securing said first profiled rods to said first corner members and said second profiled rods to said second corner members so as to form first and second side wall frames;

a plurality of transverse profiled spar members extending between said first and second side wall frames;

securing means associated with said profiled spar members and said third leg of said corner members for securing said spar members to said first and second side wall frame members so as to form a structural frame; and a plurality of covering means mounted on said structural frame such that said covering means is in tension and said structural frame is in compression.

2. A container according to claim 1 wherein each of said covering means is provided with a first and second hook shaped member and each of said profiled rods is provided with a groove wherein said plurality of covering means are mounted on said structural frame whereby said first hook shaped member engages said groove on one of said profiled rods on said first side wall frame member and said second hook shaped member engages said groove on one of said profiled rods on said second side wall frame member.

3. A container according to claim 2 wherein said plurality of tripodal corner members include means for adjusting the position of said first side wall frame member with respect to said second side wall frame member so as to seat said hook shaped members in said grooves thereby placing sad plurality of covering means in tension.

4. A container according to claim 3 wherein said adjusting means is movable so as to vary the relative positon between said first and second side wall frame members.

5. A container according to claim 3 wherein said adjusting means is associated with said third leg of said corner members.

6. A container according to claim 3 wherein said securing means associated with said third leg of said corner members comprises a bore adapted to receive said spar members.

7. A container according to claim 6 wherein said adjusting means comprises a screw movably mounted within said bore for adjusting the position of said spar members.

8. A container according to claim 2 wherein said coverings are mounted on said spar members by means of fasteners.

9. A container according to claim 1 wherein a plurality of said profiled rods forming either side wall frame member include projections adapted to releasably receive a door member.

10. A container according to claim 9 wherein said door member is formed by a flexible covering provided with a rolled seam which is adapted to rest in an undercut groove in one of said profiled rods, said undercut groove running above the doorway and having an oval cross section in the undercut region, the principal axis of which runs approximately in the plane of the door.

11. A container according to claim 10 wherein said door is provided with a plurality of flexible belts which run substantially parallel to said rolled seam, said flexible belts being provided with hooked members and further includes means for adjusting the length of said belts.

12. A method of constructing a container for transporting freight comprising:

providing a first and second plurality of profiled rods;

providing a first and second plurality of tripodal corner members;

securing said first plurality of profiled rods to said first plurality of tripodal corner members to form a first frame;

securing said second plurality of profiled rods to said second plurality of tripodal corner members to form a second frame;

providing a plurality of transverse spar members extending between said first and second frame members;

securing said first and second frame members to said plurality of transverse spar members so as to form a structural frame;

covering said structural frame with a plurality of covering members; and adjusting the position of said first side wall frame to said second side wall frame whereby said covering members are placed in tension.

* * * * *